United States Patent [19]

Sullivan

[11] Patent Number: 4,622,767

[45] Date of Patent: Nov. 18, 1986

[54] EASEL-LIKE SUPPORT

[75] Inventor: Stephen P. Sullivan, Dayton, Ohio

[73] Assignee: The Antioch Publishing Company, Yellow Springs, Ohio

[21] Appl. No.: 717,214

[22] Filed: Mar. 28, 1985

[51] Int. Cl.[4] ..... G09D 3/04

[52] U.S. Cl. ..... 40/120; 40/152.1; 248/463

[58] Field of Search ..... 40/120, 152.1; 248/456, 248/450, 459, 460, 463; 206/45.26, 45.25, 45.21

[56] References Cited

U.S. PATENT DOCUMENTS

| | | | |
|---|---|---|---|
| Re. 16,618 | 5/1927 | Kemp | 225/27 |
| 793,252 | 6/1905 | Weeks | 40/120 |
| 1,181,288 | 5/1916 | Buran | 281/45 |
| 1,224,464 | 5/1917 | Hill | 40/120 |
| 1,303,306 | 5/1919 | Heithaus | 40/152.1 |
| 1,359,662 | 11/1920 | Blyth | 40/152.1 |
| 1,669,528 | 5/1928 | Middleditch | 40/120 |
| 1,927,131 | 9/1933 | Middleditch | 40/120 |
| 2,062,916 | 12/1936 | Moore | 40/152.1 |
| 2,194,425 | 3/1940 | Hartnett | 206/45.26 |
| 2,419,823 | 4/1947 | Cross et al. | 40/152.1 |
| 2,542,647 | 2/1951 | Flanagan | 40/120 |
| 2,730,232 | 1/1956 | Coe | 206/45.26 |
| 3,113,559 | 12/1963 | Friedman | 40/120 |
| 3,210,873 | 10/1965 | Nichols | 40/120 |
| 3,275,280 | 9/1966 | Nichols | 248/459 |
| 3,447,770 | 6/1969 | Gallamos | 248/453 |

*Primary Examiner*—Robert Peshock
*Assistant Examiner*—Cary E. Stone
*Attorney, Agent, or Firm*—Biebel, French & Nauman

[57] ABSTRACT

A calendar pad support is molded as a generally planar plastic sheet having a stepped width strip or tongue formed into the sheet comprising a first rectangular portion hinged near the lower edge of the sheet and a second rectangular portion wider than the first and hingedly connected thereto. Notches are formed into the sheet adjacent to the end of the first portion and a tab is formed at the distal end of the second portion by elimination of the corners of the distal end of the second portion during molding with the tab being sized to fit within and be retained by the first and second notches when the first portion of the tongue is folded rearwardly away from the sheet and the second portion of the tongue is folded forwardly toward the sheet. Severable links connect the tongue to the sheet in the as-molded condition. A channel formed of the same material as the sheet and engaging the outer edges thereof opens to the rear of the sheet and extends beyond the front surface to present a matted outer surface of the channel to frame the calendar pad secured to the front of the sheet. Molded posts are formed into the front surface of the sheet and nylon threaded members having expanded heads are retained within smooth bores through the posts to hold the calendar pad to the support device. The sheet and channel include reinforcing ribs.

12 Claims, 6 Drawing Figures

EASEL-LIKE SUPPORT

BACKGROUND OF THE INVENTION

The present invention relates generally to structures for supporting a calendar pad, photograph or the like and, more particularly, to an easel-like structure for supporting such items in a generally upright, rearwardly inclined position.

Calendar stands which support calendar pads at a relatively small angle of incline are well known and ubiquitously displayed on desks throughout the country. A variety of such calendar stands are shown in U.S. Pat. Nos. 793,252; 1,181,288; Re. 16,618; and 1,927,131.

Other calendar stands commonly formed from cardboard and distributed by various merchants for advertising purposes are also well known as exemplified by U.S. Pat. Nos. 3,210,873 and 3,275,280. In these stands or supports, various portions, typically die-cut from cardboard, are folded to form extensions or feet which support a display face at an inclined angle.

A similar easel-like support is disclosed in U.S. Pat. No. 3,447,770 to serve as a one piece bookholder. In this disclosure, an easel-like book support is formed from a sheet of material from which a primary trapezoidal prop is cut with a secondary prop cut from within the primary prop and extending therebeyond. The secondary prop is formed to engage slots formed in the sheet such that the primary prop may be positioned at a number of angles relative to the sheet.

While these various structures are available to support a calendar pad, photograph or the like, improved support structures are always desirable to provide alternatives, particularly when such improved support structures are inexpensive to produce, present an appealing appearance and provide stable support for such items.

SUMMARY OF THE INVENTION

In accordance with the present invention, a support structure for a calendar pad, photograph or the like comprises a generally planar sheet of a relatively rigid material. Preferably, the sheet is formed of one of a variety of suitable plastics having a sufficient thickness throughout the majority of the sheet to make the sheet relatively rigid. A stepped width strip of the material or tongue is cut or otherwise formed into the sheet such that it is connected near one edge of the sheet, which is the lower edge when the support is in use, and extends toward the opposite or upper edge.

The first step of the strip or tongue comprises a first generally rectangular portion having one end which is connected near the lower edge of the sheet where it is creased or otherwise hingedly connected to permit the tongue to be moved to the rear and away from the sheet. The second step of the strip or tongue comprises a second generally rectangular portion which is wider than the first rectangular portion and extends beyond it toward the upper edge of the sheet. The union between the first and second portions is creased or otherwise hinged to permit movement of the second portion of the tongue toward the sheet as the first portion is moved to the rear and away from the sheet.

First and second notches are cut or otherwise formed into the portion of the sheet remaining on either side of the first portion of the tongue near the free end thereof, i.e., near the union between the first and second portions. The second portion of the tongue has the corners of the distal end cut away or otherwise removed during formation such that a generally rectangular tab remains at the distal end of the second portion. The tab is sized to fit within the first and second notches and extend therebetween when the first portion of the tongue is folded rearwardly away from the sheet and the second portion of the tongue is folded forwardly toward the sheet. By engaging the tab within the notches, a stable angular prop is formed and extends from the rear or backside of the planar sheet to support it in an inclined orientation for displaying whatever is secured to the front side of the sheet.

Preferably, angularly formed extensions which are wider than the second portion project from and beyond the sides thereof near the union between the first and second portions of the tongue. The lower ends of the extensions also project beyond the hinged interconnection between the first and second portions of the tongue to form support feet at either side of the second portion of the tongue when the tongue is folded to form the angular prop.

At least first and second severable links connect the lateral edges of the tongue, preferably along the second portion thereof, to the planar sheet to retain the tongue in the plane of the sheet initially and prior to severence of the links. This facilitates packaging of the support structure of the present invention in a collapsed form prior to use.

An opening is cut or otherwise formed into the sheet of material beyond the distal end of the tongue. The opening is approximately centered on the sheet to permit the sheet to be hung on a projection from a wall or other structure with the projection extending through the opening. When the support is hung, the tongue remains in the plane of the sheet to display whatever is secured to the front side of the sheet.

Frame means extend from the outer edges of the planar sheet for framing whatever is mounted to the front side of the sheet. The frame means preferably comprises a contiguous channel of the same material as the planar sheet. The channel has one edge connected to the outer edge of the planar sheet and is open to the rear of the sheet such that a closed outer surface of the channel extends beyond the front side of the sheet to attractively frame whatever is secured thereto. To further enhance the appearance, the outer surface of the channel is textured or matted.

When the support structure is to be used to support a calendar pad, means are provided for securing the calendar pad to the front side of the sheet. The calendar pad securing means preferably comprises first and second molded posts having smooth bores formed therethrough and positioned to be received within holes formed through the sheets of the calendar pad. First and second retaining members formed of a resilient material, such as nylon, are sized to be forced into the bores of the posts and retained by friction therein. The retaining members preferably include encircling projections or threads and have expanded heads to retain a calendar pad on the posts. The retaining members are easily removed by the application of a combined rotational and withdrawing force to install a new calendar pad at year end.

Preferably, upstanding ribs are formed into and extend from the front surface of the planar sheet to reinforce the planar sheet and support the calendar pad or other item secured to the sheet at a plane parallel to, but spaced from, the front surface of the planar sheet. The reinforcing ribs also define a space for extension of a projection through the opening in the sheet if the support is to be hung.

One or more channel reinforcing ribs are formed to span the channel defining the frame surrounding the front surface of the sheet. Such channel reinforcing ribs are formed at least in the bottom portion of the frame to prevent distortion of that portion of the channel frame when the structure is supported by the angular prop. Additional channel reinforcing ribs may be formed to ensure adequate support and an attractive, undistorted appearance of the frame.

It is, therefore, an object of the present invention to provide an improved support structure for a calendar pad, photograph or the like which comprises a generally planar sheet of relatively rigid material with a dual stepped and hinged tongue cut or formed thereinto which tongue can be folded to form an angled prop for supporting the structure in a substantially upright, inclined position.

This, as well as other objects and advantages of the present invention, will become more apparent upon a review of the detailed description of the invention with reference to the drawing figures.

DETAILED DESCRIPTION OF THE INVENTION

Figure 1:
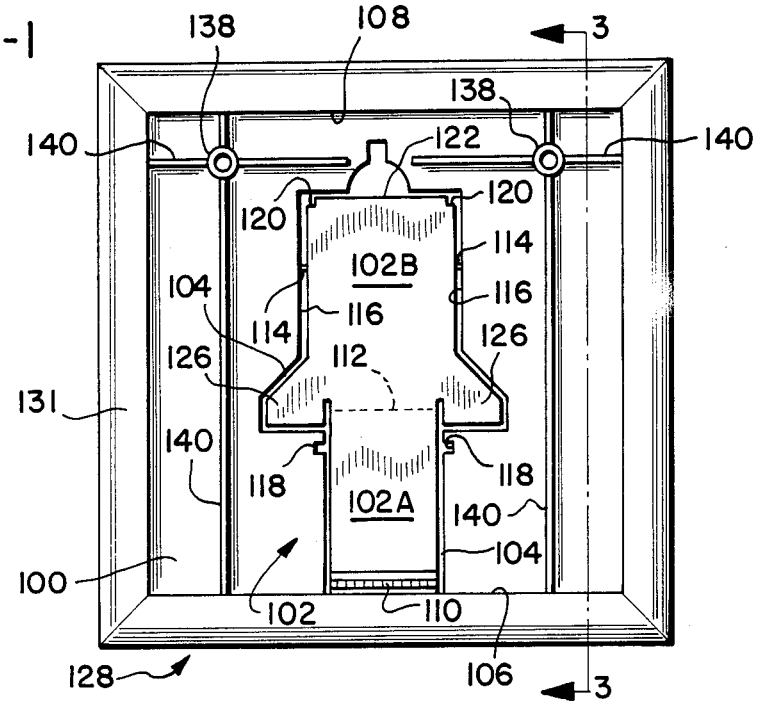
FIG. 1 is a front view of a calendar pad support device in accordance with the present invention in its as-formed or molded condition.

An illustrative embodiment of a support device for a calendar pad is shown in the drawing FIGS. 1–6. While the support device as illustrated is adapted to support a calendar pad, it should be apparent that the device can also be used to support photographs or similar items.

The base element of the support device comprises a generally planar sheet 100 formed of a relatively rigid material. The preferred embodiment is formed from a plastic material such that the entire structure can be molded during a single operation to provide inexpensive production of the device. A variety of plastics can be used to form the support device, as will be apparent to those skilled in the art of plastic molding, with the selection and thickness of a particular plastic material being made to satisfy the rigidity requirements of the device. It should also be appreciated that cardboard or other materials can be utilized to manufacture support devices incorporating the essence of the present invention.

In the preferred embodiment of the support device, a prop forming strip or tongue 102 is formed such that the tongue 102 is separated from the remainder of the sheet 100 by a gap 104 formed into the material which gap substantially surrounds three sides of the tongue 102. The fourth side of the tongue 102 is connected near the lower edge 106 of the sheet 100 and extends towards the opposite or upper edge 108 of the sheet. A first, generally rectangular portion 102A of the tongue 102 connects the tongue 102 to the remainder of the sheet 100 by means of a hinge 110 which comprises a thinned strip of the plastic material which forms the support device.

A variety of formations for plastic molded hinges are well known and any of such hinges can be incorporated in the present invention. The hinge 110 is formed such that the tongue 102 may be moved away from the generally planar sheet 100 toward the rear of the sheet or into the plane of the drawing as shown in FIG. 1. In the event that the support device is constructed from cardboard or a similar material, the hinge 110 may be formed by appropriately creasing the material in that vicinity.

A second generally rectangular portion 102B of the tongue 102 is wider than the first rectangular portion 102A and extends therebeyond toward the upper edge 108 of the sheet 100. The second portion 102B of the tongue 102 is hingedly connected to the first portion 102A by means of a hinge 112. The hinge 112 is formed such that the second portion 102B can be folded back toward the sheet 100 or out of the plane of the drawing as shown in FIG. 1. Here again, the hinge 112 may be any form of molded plastic hinge in the event plastic is used to form the support device or can be a crease in the event that cardboard or a similar material is utilized.

In the support device, as formed, the tongue 102 is retained within the plane of the sheet 100 by means of frangible links 114. The links 114 preferably innerconnect the wider second portion 102B of the tongue 102 to the sidewalls 116 of the remainder of the planar sheet 100 by bridging the gap 104 formed between the tongue 102 and the remainder of the sheet 100. First and second notches 118 are formed into the sidewalls 116 of the sheet 100 near the free end of the first portion 102A of the tongue 102. The second portion 102B of the tongue 102 has the corners 120 of the distal end cut away or otherwise removed, such as during molding, to define a tab 122 at the distal end of the second portion 102B. The tab 122 is sized to fit within the notches 118 and extend therebetween.

Figure 5:
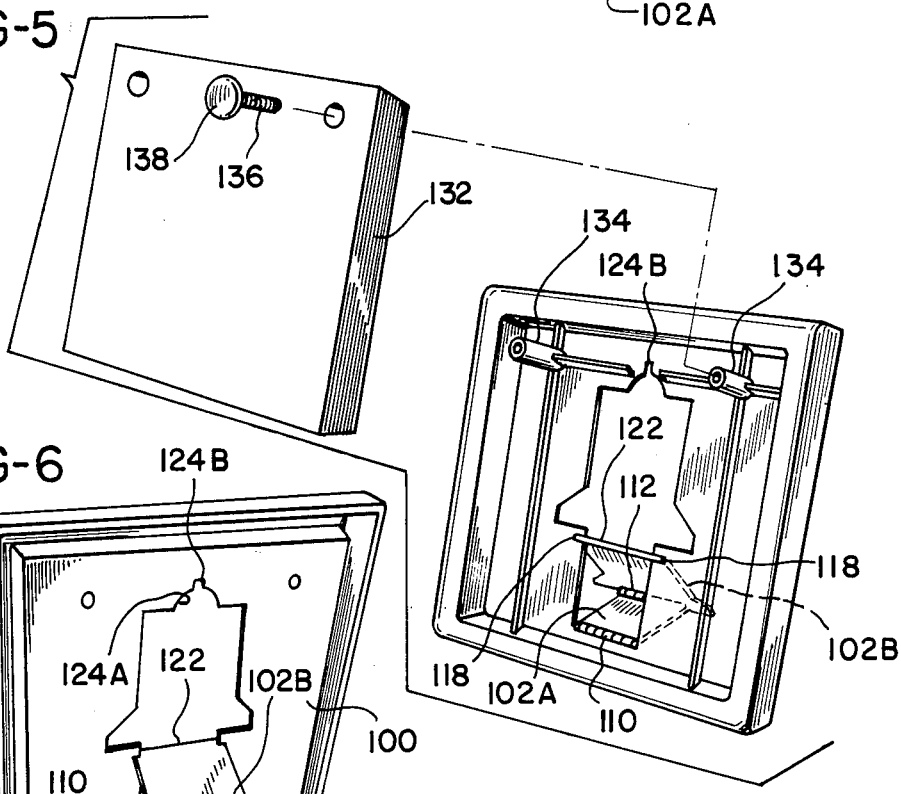
FIG. 5 is an exploded front perspective view of the support device of the present invention in its inclined support position showing the attachment of a calendar pad.
Figure 6:
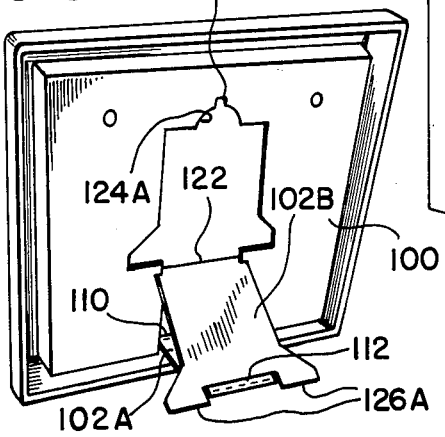
FIG. 6 is a rear perspective view of the support device of the present invention in its inclined support position.

If the support device of the present invention is to be supported in a generally upright inclined orientation, the links 114 are severed and the first portion 102A of the tongue 102 is hingedly moved toward the rear of the sheet 100. At the same time, the second portion 102B of the tongue 102 is moved toward the sheet 100 with the hinged movement of the portions 102A and 102B being continued until the tab 122 is engaged within the notches 118 to form a stable angular prop which serves to support the device as best shown in FIGS. 5 and 6.

To add to the versatility of the present invention, an opening 124 is formed, cut or otherwise made through the sheet of material 100 beyond the distal end of the tongue 102 and substantially centered on the sheet 100. The opening 124 comprises a generally semicircular portion 124A with a generally rectangular notch 124B extending from the top thereof. If the support device of the present invention is to be hung on a wall or other structure, the opening 124 is used to receive a projection (not shown) such as a nail or hanger which projects from the wall or other structure. In the event that the support device is supported by a projection extending through the opening 124, the links 114 are not severed such that the tongue 102 remains centered within the gap 104 and in the plane of the sheet 100.

Preferably, the second portion 102B of the tongue 102 includes angularly formed extensions 126 which extend from and beyond the edges of the second portion 102B and below the hinge 112 interconnecting the first portion 102A and the second portion 102B. The formation of the extensions 126 serves to define support feet 126A at either side of the tongue 102 when the tongue is folded to form an angular prop as best shown in FIG. 6.

Figure 2:
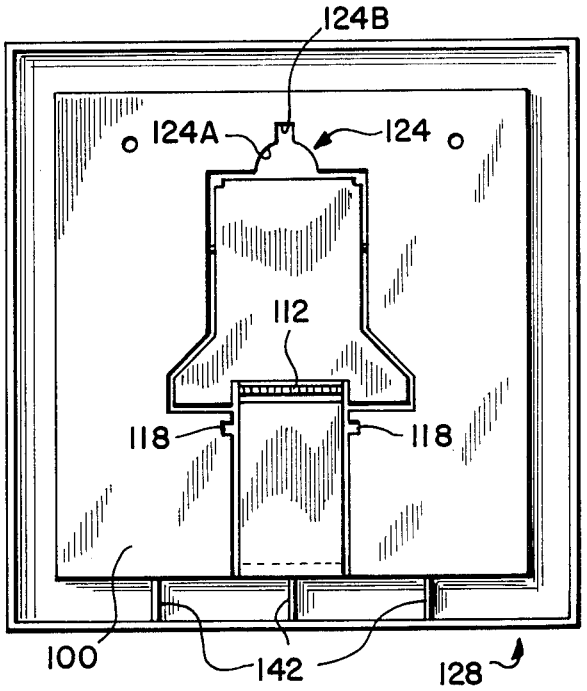
FIG. 2 is a rear view of the support device of FIG. 1.
Figure 3:
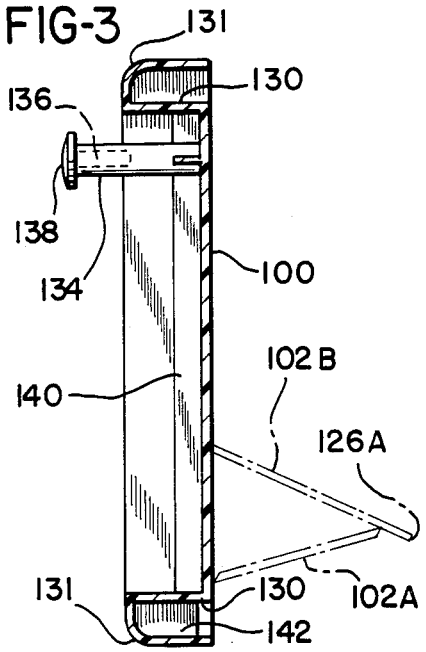
FIG. 3 is a sectional side view of the support device of the present invention taken along the line 3—3 of FIG. 1 with a phantom view of the extended support prop.
Figure 4:
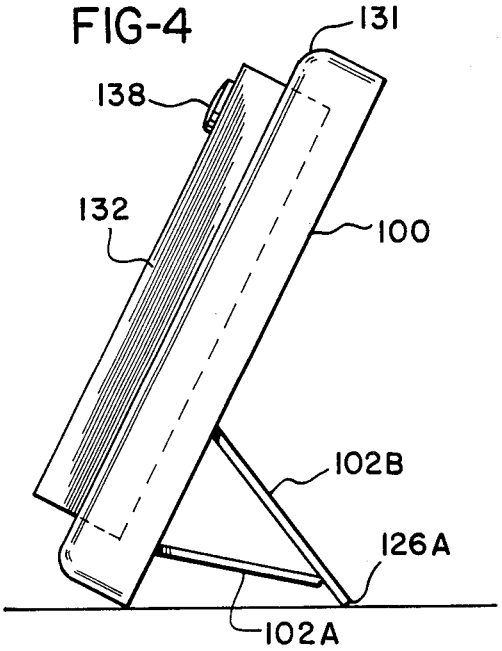
FIG. 4 is a side view of the calendar support device of FIG. 1 supported by the angled support prop and with a calendar pad secured thereto.

To enhance the appearance of the support device of the present invention and increase the rigidity of the sheet 100, frame means comprising a channel 128 is formed integrally with the sheet 100. The channel 128 is open to the rear of the sheet 100 as best seen in FIGS. 2 and 3. The frame means or channel 128 is preferably formed of the same material as the planar sheet 100 with an inner edge 130 of the channel 128 joined to the outer edges of the planar sheet 100 such that the closed outer surface 131 of the channel 128 extends outwardly beyond the front side of the sheet 100 to frame whatever is secured thereto. A textured or matted finish is molded or otherwise formed into the outer surface of the channel 128 to enhance the appearance of the support structure of the present invention.

A calendar pad 132 is secured to the illustrated support device by means of first and second molded posts 134 which have smooth bores formed therethrough and are positioned to be received within holes formed through the calendar pad 132. First and second retaining members 136 are formed of a resilient material, preferably nylon, and sized to be forced into the bores of the molded posts 134 to be retained therein by friction. The retaining members 136 include expanded heads 138 to hold the calendar pad 132 on the posts 134. The retaining members 136 preferably include circular projections which can be screw threads and the projections or screw threads may be deformed to assist in the frictional retention of the members within the posts 134. The retaining members 136 are readily removed from the posts 134 by application of a withdrawing force coupled with rotation to facilitate replacement of the calendar pad 132.

Preferably, reinforcing ribs 140 are formed with and extend from the front of the planar sheet 100 to reinforce and strengthen the planar sheet. The reinforcing ribs 140 are shown in the illustrated embodiment as intersecting and joining with the molded posts 134; however, many other patterns for the ribs are possible. The reinforcing ribs 140 also support the calendar pad 132 at a plane parallel to, but spaced from, the front surface of the planar sheet 100. The spacing afforded by the reinforcing ribs 140 facilitates hanging the support device by means of a projection which extends through the opening 124 formed into the sheet 100.

The channel 128 which forms the frame means surrounding the front of the sheet 100 may be deformed particularly toward the bottom of the support when the support device rests thereon. Accordingly, channel ribs 142 shown in FIGS. 2 and 3 are formed to span and reinforce the channel 128 at least in the lower portion of the channel. It may be desirable for additional channel reinforcing ribs 142 to be formed at other locations around the frame to prevent potential distortion of the frame channel 128. However, such ribs will normally not be required if the frame channel 128 is formed of a sufficient thickness of material.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A support structure for a calendar pad, photograph or the like comprising:

a generally planar and rectangular single sheet of a relatively rigid material, said sheet having lower and upper edges;

a tongue of said material having one end thereof hingedly connected to said sheet near the lower edge thereof and extending toward and terminating at an opposite end near the upper edge of said sheet, said tongue having a first generally rectangular portion and a second generally rectangular portion wider than said first rectangular portion extending beyond said first portion and hingedly connected to said first portion to permit movement of said second portion toward the front of said sheet; and first and second notches formed into said sheet on opposite sides of said first portion of said tongue and near the point where said second portion of said tongue is hingedly connected to said first portion, said second portion of said tongue having the corners of a distal end thereof cut away or otherwise removed to form a tab at the distal end of said second portion, which tab is sized to fit within said notches and extend therebetween; whereby said first rectangular portion may be folded toward the rear of said planar sheet and said second rectangular portion may be folded toward the front of said planar sheet, said first and second rectangular portions being positioned such that said tab engages said notches to form a stable angular prop extending from the rear of said planar sheet to support said planar sheet in an inclined orientation for displaying whatever is secured to the front of said planar sheet.

2. A support structure as claimed in claim 1 further comprising frangible link means connecting said tongue to said planar sheet to retain said tongue in the plane of said planar sheet prior to severance of said link means.

3. A support structure as claimed in claim 2 further comprising an opening formed into said sheet of material beyond said distal end of said tongue to permit said planar sheet to be hung on a projection to display whatever is secured to the front side of said planar sheet from a wall or other structure which supports said projection.

4. A support structure as claimed in claim 3 wherein said second portion of said tongue includes angularly formed extensions wider than said second portion and extending beyond the hinged interconnection of said first and second portions of said tongue to form support feet at either side of said tongue when said tongue is positioned to form said angular prop.

5. A support structure as claimed in claim 4 further comprising frame means extending from the outer edges of said planar sheet for framing the front side thereof.

6. A support structure as claimed in claim 5 wherein said frame means comprises a channel of the same material as said planar sheet, said channel having one edge joined to outer edges of said planar sheet and being open to the rear thereof such that a closed outer surface of said channel extends outwardly beyond the front side of said sheet to frame whatever is secured thereto.

7. A support structure as claimed in claim 6 further comprising means for securing a calendar pad to the front side of said sheet.

8. A support structure as claimed in claim 7 which is molded from a plastic material and wherein said calendar pad securing means comprises first and second molded posts having smooth bores therethrough and being positioned to be received within holes formed through a calendar pad, and first and second retaining members formed of a resilient material and sized to be forced into the bores of said posts and retained by friction therein yet easily removed by rotation and a withdrawing force, said retaining members including expanded heads to hold said calendar pad to said posts.

9. A support structure as claimed in claim 8 further comprising reinforcing ribs formed into and extending from the front of said planar sheet to reinforce said planar sheet and support said calendar pad at a plane parallel to, but spaced from, the front surface of said planar sheet.

10. A support structure as claimed in claim 9 further comprising at least one reinforcing rib formed to span said channel at least in the portion of said frame toward the bottom of said support structure to prevent distortion of said channel.

11. A support structure as claimed in claim 10 wherein said retaining members comprise threaded screws.

12. A support structure as claimed in claim 11 wherein said closed outer surface of said channel is textured.

* * * * *